US005583942A

United States Patent [19]

van den Berg

[11] Patent Number: 5,583,942

[45] Date of Patent: Dec. 10, 1996

[54] DEVICE OF THE DUMMY HEAD TYPE FOR RECORDING SOUND

[76] Inventor: Josée M. van den Berg, Hofmark 362, Almere-Haven, Netherlands, 1355 JG

[21] Appl. No.: 244,480

[22] PCT Filed: Nov. 27, 1992

[86] PCT No.: PCT/NL92/00218

§ 371 Date: May 27, 1994

§ 102(e) Date: May 27, 1994

[87] PCT Pub. No.: WO93/11648

PCT Pub. Date: Jun. 10, 1993

[30] Foreign Application Priority Data

Nov. 28, 1991 [NL] Netherlands ..... 9101993

[51] Int. Cl.[6] ..... H04R 5/00

[52] U.S. Cl. ..... 381/26

[58] Field of Search ..... 381/26

[56] References Cited

U.S. PATENT DOCUMENTS 4,680,856 7/1987 Zuccarelli .
5,031,216 7/1991 Gorike et al. ..... 381/26

FOREIGN PATENT DOCUMENTS 0056479 7/1982 European Pat. Off. .
2437373 2/1976 Germany .
3733494 4/1988 Germany .
0038213 3/1977 Japan ..... 381/26
53-012602 4/1978 Japan .

OTHER PUBLICATIONS

John Sunier, "A History of Binaural Sound", Mar. 1986, pp 36–46.

*Primary Examiner*—Curtis Kuntz
*Assistant Examiner*—Minsun Oh
*Attorney, Agent, or Firm*—Dvorak and Traub

[57] ABSTRACT

Disclosed is a device of the dummy head type for recording sound. It comprises a supporting body fitted with an anatomically faithful imitation of the human auricle. The auricle is coupled to a channel inside the body. This channel opens into the imitated auricle and corresponded to an auditory meatus of anatomical construction and length. It further comprises a microphone arranged behind the channel, such that the position of the membrane of the microphone relative to the imitated auditory meatus and auricle corresponds as much as possible to the anatomical position of the human eardrum relative to the associated auditory meatus and auricle. According to the invention, the channel has an open end on the side of the microphone and the microphone is arranged in front of this open end. A dummy head according to the invention comprises two devices as described, with the supporting plate of each mounted on opposite sides of a dividing plate by means of a bracket.

5 Claims, 2 Drawing Sheets

DEVICE OF THE DUMMY HEAD TYPE FOR RECORDING SOUND

The invention relates to a device of the dummy head type for recording sound, comprising a supporting body provided with an anatomically faithful imitation of the human auricle coupled to a channel inside the body which opens into the imitated auricle, this channel corresponding to an auditory meatus of anatomical construction and length, and a microphone arranged behind the channel, such that the position of the membrane of the microphone relative to the imitated auditory meatus and auricle corresponds as much as possible to the anatomical position of the human eardrum relative to the associated auditory meatus and auricle.

Such a device is disclosed in U.S. Pat. No. 4,680,856. The known device has the shape of a human head. A number of components of the human head have been imitated so as to be anatomically faithful. This particularly applies to the associated auricles and the auditory meatuses. At the back end of each of the auditory meatuses, in exactly the same place where the eardrum is located in humans, the membrane of a microphone is arranged. It is believed that by means of such an artificial head, sound can be recorded with the highest possible fidelity, so as to enable reproduction with the highest possible fidelity afterwards. However, in practice, it has been found that recording sound by means of the known device is still not optimal.

The object of the present invention is to provide a device which is better capable of recording sound, such that a reproduction of an extremely high fidelity can be realized.

The object contemplated is realized according to the invention by means of a device of the type set forth in the opening paragraph hereof, wherein the supporting body is suspended from a plate and the channel has an open end on the side of the microphone, with the microphone arranged adjacent this open end in the space between the supporting body and the plate, such that an open connection is maintained with the imitated auditory meatus and the space outside the device.

Essential to the device according to the invention is the auditory meatus kept open on both sides of the imitated ear. Hence, the microphone is arranged such that an open connection is maintained with both the auditory meatus and the space outside the device. As a result, the auditory meatus forms, as it were, an open organ pipe for the sounds entering via the auricle and the energy transfer of the sounds occurs in a manner more or less analogous with that in nature. Thus, the sound has been found to be of an extremely high fidelity when reproduced later. The auditory meatus being open on both sides prevents interfering resonances occurring in an auditory meatus which is closed on one side by the microphone as a result of the formation of an undesired acoustic Helmholtz resonator in important frequency ranges. Further, the auditory meatus being open on both sides contributes to a better processing of the sound energy, modified via a physiological form (ear and auditory meatus), by the sound recorder (microphone).

It is further observed that German Offenlegungsschrift 37 33 494 discloses a device for recording sound, in which anatomically faithful imitations of the human auricle are utilized. FIG. 6 of that publication shows an embodiment with a microphone arranged in a chamber behind an imitated auditory meatus, this chamber being larger than the auditory meatus. However, a damping mass is arranged between the auditory meatus and the microphone. Accordingly, this construction is comparable to a closed organ pipe. Because of this dancing mass, the auditory meatus is not open on both sides.

Further, Patent Abstracts of Japan, Volume 2, No. 49, gives a summary of the invention described in JP-A-53.012, 602. This publication relates to a microphone of the dummy head type having microphones accommodated in a dummy head, which connect to auricles via a channel. No anatomically faithful imitation seems to be involved here. Nor do the channels have an open end on the side of the microphones. On the other hand, there are additional channels between each auditory meatus channel and other parts of the surface of or cavities in the dummy head, which additional channels are to be filled with damping material.

In a suitable embodiment of the device according to the invention, the microphone is arranged behind the open end of the channel, such that a wedge-shaped gap is formed between this end and the membrane.

In another suitable embodiment of the device according to the invention, a sound wall is provided on the supporting body in the recording direction in front of the microphone, so as to prevent sound pressures directed from before the device along the supporting body to the microphone.

The invention further provides a dummy head for recording sound, comprising two devices according to the invention, the supporting body of each device consisting of a plate of suitable material, and the supporting plates of the two devices being each mounted by means of a bracket on opposite sides of a suitable dividing plate. Preferably, the bracket on each supporting body provides a socalled "tuning fork" suspension of the relevant body. By means of such a suspension, a high degree of acoustic uncoupling of supporting body and dividing plate is realized.

For aesthetic and practical reasons, the supporting plates and the dividing plate are appropriately made of circular design, with the diameter of the dividing plate being approximately equal to the average diameter of a human head. Preferably, the supporting plates are maintained by the respective brackets at such a distance from the dividing plate, that the distance between the two auricles on opposite sides approximates the distance between the ears of an average human.

The invention will now be illustrated, by way of example only, with reference to the accompanying drawings, in which.

In the drawings, similar or corresponding elements have been provided with the same reference numerals.

Figure 1:
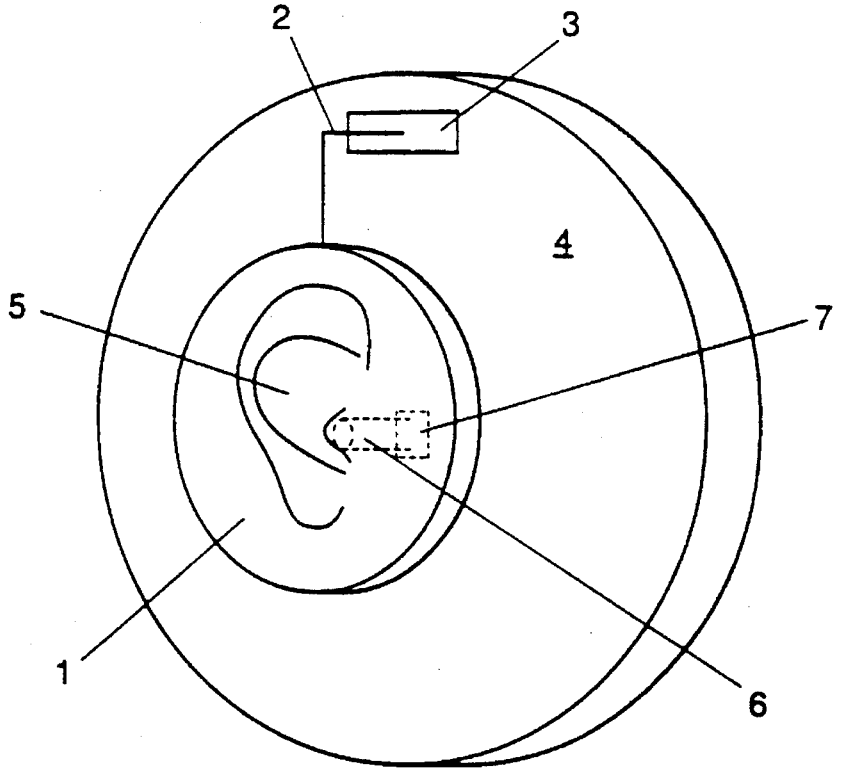
FIG. 1 is a schematic representation in side/front view of an embodiment of the device according to the invention.

In FIG. 1, a supporting body 1 in the form of a substantially circular disc is connected to a plate 4, likewise substantially circular and disc-shaped, by means of a suitable bracket 2, attached to the top of support 1 in the embodiment shown, mounted, at the end remote from support 1, on a supporting strip 3. The suspension of support 1 from plate 4 is preferably of the "tuning fork" type, so as to keep support 1 and plate 4 acoustically uncoupled as much as possible. If so desired, the connection of support 1 to bracket 2 may be flexible or rotatable, so that the direction and distance of the auricle, to be mentioned hereinafter, relative to plate 4 can be modified and adjusted as desired. Supporting body 1 and plate 4, which has a greater diameter than support 1, are made of a suitable material and are preferably covered with an acoustically damping material. Mounted on supporting body 1, on the side remote from plate 4, is a body 5 in the form of a human auricle, imitated as faithfully as possible. The connection of auricle 5 to support 1 is acoustically uncoupled as much as possible.

A channel 6, indicated in FIG. 1 by broken lines, extends from the entrance of the imitated ear 5 through support 1 to the side thereof remote from ear 5. Channel 6 is an imitation as faithful as possible of an auricle of anatomical construction and length. Arranged near the end of auricle 6 on the side of support 1 remote from ear 5 is a microphone 7 (indicated in FIG. 1 in broken lines). Microphone 7 is arranged such that the position of the membrane of the microphone corresponds as much as possible to the anatomical position of the human eardrum, while the arrangement should further be such that auditory meatus 6 is not closed by microphone 7.

Unlike constructions known heretofore, the construction described has an auditory meatus that is open on both sides. Thus, the auditory meatus does not constitute a closed organ pipe, as it does in the known devices, but is comparable to an open organ pipe for the sounds entering via the auricle, so that the sound pressures are transmitted in a manner more or less analogous with that in nature.

For a proper true-to-life recording of sounds, use can best be made of two devices of the type shown in FIG. 1, which preferably form each other's mirror image. The relevant ears are preferably arranged at a distance comparable to the distance between the ears of a human. However, this distance could be varied for particular effects. In that case, two separate supports 1 could be used, each optionally suspended from a separate dividing plate 4, if desired independently of each other on a standard, whilst the relevant devices may or may not form each other's mirror image. In cases where it is desired that the "natural" distance be maintained, the simplest way of doing so is to combine two of the devices according to FIG. 1 into a single dummy head. A preferred embodiment of such a dummy head is shown in front view in FIG. 2.

Figure 2:
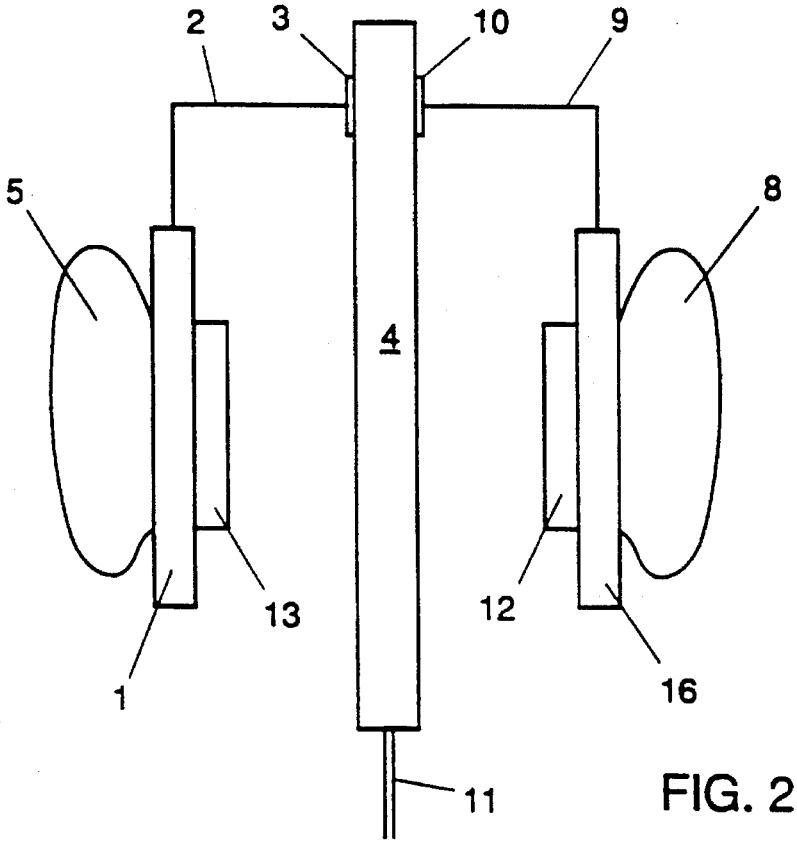
FIG. 2 is a representation in front view of a preferred embodiment of the dummy head according to the invention.

The dummy head according to FIG. 2 comprises a central dividing plate 4 with mounting strips 3 and 10 of the respective brackets 2 and 9 mounted on opposite sides at the top thereof. Dividing plate 4 is mounted on a suitable standard 11. The brackets 2 and 9 provide a "tuning fork" suspension of the supporting bodies 1 and 16 respectively on both sides of the dividing plate 4. Mounted on supports 1 and 16, on the side remote from dividing plate 4, are the faithful imitations of human ears 5 add 8 respectively. On the side of supports 1 and 16 facing dividing plate 4, microphones are mounted. In the front view of FIG. 2, these microphones are not visible, because they are hidden from view by sound walls 13 and 12, mounted on supports 1 and 16 respectively in front of the microphones. Sound walls 13 and 12 are arranged frontally before the relevant microphones so as to prevent "undirected" sound pressures coming from the front from reaching the microphones.

Figure 3:
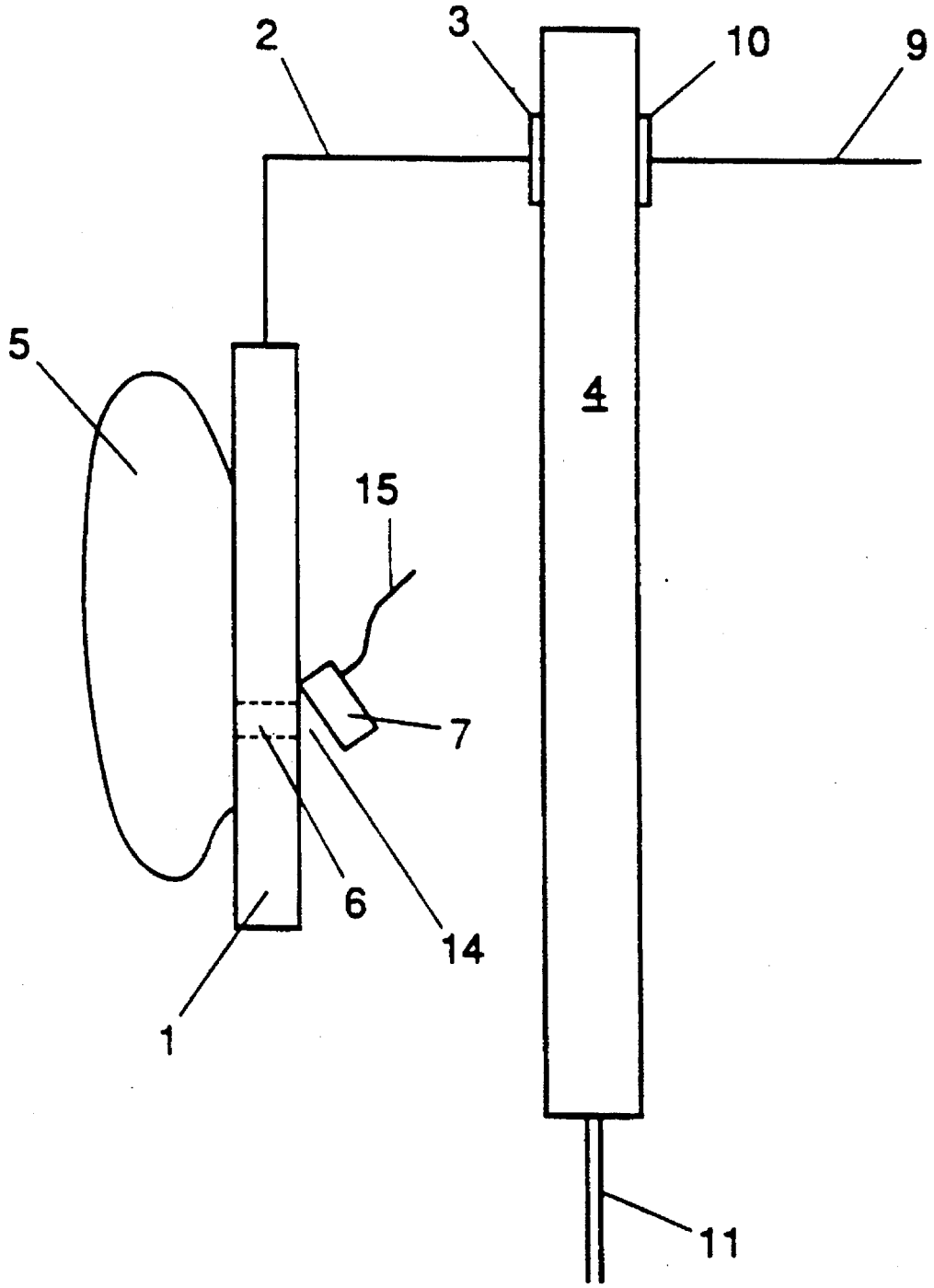
FIG. 3 is a sectional representation of a part of the device according to FIG. 2.

In FIG. 3 a part of the device according to FIG. 2 is shown in section. The section is taken at channel 6 through support 1. It can be seen how the outlet of channel 6 on the side of support 1 remote from ear 5 is a free, i.e. non-closed, outlet. Arranged near this outlet is microphone 7, the membrane of which has a position relative to channel 6 that is similar to the position of the human eardrum relative to the auditory meatus. Thus, there is a wedge-shaped gap 14 between support 1 and microphone 7, channel 6 opening into this gap 14.

By means of an electrical lead 15, microphone 7 is connected to processing equipment, not shown, for processing the signals recorded by microphone 7. When a dummy head according to the invention is used for recording sounds, an extremely faithful reproduction of recorded sound has been found to be possible, such reproduction being more faithful than could be realized by using dummy heads known heretofore. Further, the construction according to the invention with supporting plates and a dividing plate can be made of very light weight.

I claim:

1. A device of the dummy head type for recording sound, comprising a supporting body (1) provided with an anatomically faithful imitation (5) of the human auricle coupled to a channel (6) inside the body which opens into the imitated auricle (5), said channel (6) corresponding to an auditory meatus of anatomical construction and length, and a microphone (7) arranged in free space behind the channel (6), such that the position of the membrane of the microphone (7) relative to the imitated auditory meatus and auricle (5) corresponds as much as possible to the anatomical position of the human eardrum relative to the associated auditory meatus and auricle, characterized in that the supporting body (1) is suspended from a dividing plate (4), having a diameter approximately equal to the diameter of the average human head and located behind the imitation auricle at approximately one half the distance between the average human auricles, and that the channel (6) has an open end on the side of the microphone (7), with the microphone (7) being arranged adjacent said open end in the free space between the supporting body (1) and said dividing plate (4), such that an open connection is maintained with the imitated auditory meatus (6) and the space outside the device, and wherein the microphone (7) is arranged such that a wedge-shaped gap is formed between the open end of the channel (6) and the membrane of the microphone (7).

2. The device according to claim 1, wherein a sound wall (12,13) is provided on the supporting body (1) in the recording direction in front of the microphone (7), to prevent sound waves passing along the side of the supporting body from reaching the microphone.

3. A dummy head for recording sound, comprising two devices according to claim 1, wherein the supporting body (1,16) of each device consists of a plate of suitable material, and the supporting plates (1,16) of the two devices are each mounted on opposite sides of a suitable dividing plate (4) by means of a bracket (2,9).

4. A dummy head for recording sound, comprising two devices according to claim 1, wherein the supporting body (1,16) of each device consists of a plate of suitable material, and the supporting plates (1,16) or the two devices are each mounted on opposite sides of a suitable dividing plate (4) by means of a bracket (2,9).

5. A dummy head for recording sound, comprising two devices according to claim 2, wherein the supporting body (1,16) of each device consists of a plate of suitable material, and the supporting plates (1,16) or the two devices are each mounted on opposite sides of a suitable dividing plate (4) by means of a bracket (2,9).

* * * * *